US008044885B2

(12) United States Patent
Choi

(10) Patent No.: US 8,044,885 B2
(45) Date of Patent: Oct. 25, 2011

(54) DRIVING DEVICE OF PLASMA DISPLAY PANEL AND METHOD

(75) Inventor: Hak-ki Choi, Suwon-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 916 days.

(21) Appl. No.: 12/036,113

(22) Filed: Feb. 22, 2008

(65) Prior Publication Data

US 2008/0204442 A1 Aug. 28, 2008

(30) Foreign Application Priority Data

Feb. 23, 2007 (KR) ..... 10-2007-0018665

(51) Int. Cl.
*G09G 3/28* (2006.01)

(52) U.S. Cl. ..... 345/60; 345/204

(58) Field of Classification Search ..... 345/60–72, 345/204, 211–213; 315/169.1–169.4
See application file for complete search history.

(56) References Cited

U.S. PATENT DOCUMENTS

| | | | | |
|---|---|---|---|---|
| 6,906,690 | B2 * | 6/2005 | Lim | 345/60 |
| 7,414,597 | B2 * | 8/2008 | Choi et al. | 345/60 |
| 7,460,087 | B2 * | 12/2008 | Kim et al. | 345/60 |
| 7,567,225 | B2 * | 7/2009 | Chae et al. | 345/60 |
| 7,719,490 | B2 * | 5/2010 | Shim et al. | 345/68 |
| 7,868,853 | B2 * | 1/2011 | Choi | 345/60 |
| 2005/0068262 | A1 * | 3/2005 | Mizobata et al. | 345/60 |
| 2006/0187150 | A1 * | 8/2006 | Cho et al. | 345/68 |
| 2006/0232506 | A1 * | 10/2006 | Jeong | 345/60 |
| 2006/0232512 | A1 * | 10/2006 | Kim | 345/60 |
| 2007/0171151 | A1 * | 7/2007 | Jung et al. | 345/67 |
| 2008/0136807 | A1 * | 6/2008 | Jeon et al. | 345/212 |

FOREIGN PATENT DOCUMENTS

| | | |
|---|---|---|
| JP | 2004-325568 | 11/2004 |
| KR | 10-2005-0119993 | 12/2005 |
| KR | 10-2006-0004172 | 1/2006 |
| KR | 10-2006-0059460 | 6/2006 |
| KR | 10-2006-0082745 | 7/2006 |
| KR | 10-0627415 | 9/2006 |
| KR | 10-0670151 | 1/2007 |

OTHER PUBLICATIONS

Patent Abstracts of Japan, Publication No. 2004-325568, Published on Nov. 18, 2004, in the name of Koizumi et al.
Korean Patent Abstracts, Publication 1020060004172 A, Published Jan. 12, 2006, in the name of Cho.
Korean Patent Abstracts, Publication 1020060059460 A, Published Jun. 02, 2006, in the name of Kim.
Korean Patent Abstracts, Publication 1020060082745 A, Published Jul. 19, 2006, in the name of Ryu.
KIPO Office action dated Jul. 3, 2009, for priority Korean application 10-2007-0018665.

* cited by examiner

*Primary Examiner* — Sumati Lefkowitz
*Assistant Examiner* — Rodney Amadiz
(74) *Attorney, Agent, or Firm* — Christie, Parker & Hale, LLP

(57) ABSTRACT

A driving device of a plasma display panel for performing a reset period using a ramp pulse. The driving device changes the lowest potential of the ramp down pulse in response to temperature change in order to prevent or reduce low discharge or over-discharge due to the temperature change. The amount of wall charges in the pixels are maintained substantially constant over a temperature range to provide an optimal discharge condition, making it possible to prevent the discharge error and perform the low voltage address operation, in the address period.

14 Claims, 7 Drawing Sheets

DRIVING DEVICE OF PLASMA DISPLAY PANEL AND METHOD

CROSS-REFERENCE TO RELATED APPLICATION

This application claims priority to and the benefit of Korean Patent Application No. 10-2007-0018665, filed on Feb. 23, 2007, in the Korean Intellectual Property Office, the entire content of which is incorporated herein by reference.

BACKGROUND

1. Field of the Invention

The present invention relates to a driving device of a plasma display panel, and more particularly, to a driving device of a plasma display panel for performing a reset period using a ramp pulse.

2. Description of the Related Art

The plasma display panel (PDP) is a flat panel display for displaying letters or images by exciting phosphors to emit light using a gas discharge in a plasma state. The PDP has higher brightness and luminous efficiency and wider viewing angle than a liquid crystal display (LCD) and a field emission display (FED) so that PDP has been in the spotlight as a display to replace cathode ray tubes (CRTs).

The PDP is classified into a DC type and an AC type according to the pixel structure arranged in a matrix form and the waveform of a driving voltage. In the DC type all electrodes are exposed to a discharge space so that charges directly move between corresponding electrodes; however in the AC type, at least one electrode of the corresponding electrodes is covered with a dielectric so that the charges do not directly move between the corresponding electrodes.

Also, the PDP is classified into a facing discharge structure and a surface discharge structure according to the method of constructing electrodes for discharge. In the facing discharge structure an address discharge for selecting a pixel and a sustain discharge for sustaining discharge occurs between a scan electrode (e.g., positive electrode) and an address electrode (e.g., negative electrode). However, in the surface discharge structure an address discharge for selecting a pixel occurs between an address electrode and a scan electrode crossing the address electrode, and a sustain discharge for sustaining discharge occurs between a scan electrode and a sustain electrode in parallel with the scan electrode.

Referring to FIG. 1, the PDP having the above described structure displays images in gray scale in a time division driving method by dividing a unit frame into a plurality of subfields SF1 to SF6. Each of the subfields SF1 to SF6 is driven in a reset period to make the charge state of a pixel uniform, an address period A1 to A6 to accumulate wall charges on the pixels to be driven, and a sustain discharge period S1 to S6 to sustain discharge the pixels. For such a driving method, each electrode is applied with a corresponding waveform of voltage signal (e.g., a predetermined waveform).

Although FIG. 1 shows the unit frame being divided into six subfields SF1 to SF6, the number of the subfields is not limited as such, and the image quality may improve with higher number of subfields. As a result, methods of dividing the unit frame into 10 to 12 or more subfields have been studied. Furthermore, if the number of the subfields increases, false contour, an important element of image quality, of the displayed image can be reduced to improve image quality.

Meanwhile, other elements for improving the image quality and maintaining the operating margin of the PDP may also be implemented. As one method of maintaining the operating margin of the PDP, a ramp reset method is used. Referring to FIG. 2, a ramp reset is performed in a reset period PR to prepare the pixels of the PDP for low voltage address operation by allowing a large amount of wall charges to be accumulated on the walls of the pixels using weak discharge and then allowing erasing of the rest of wall charges so that only the wall charges suitable for the low voltage address operation remain on the walls of the pixels of the PDP. The ramp reset method uses a voltage signal waveform including a ramp up pulse A and a ramp down pulse B as shown in FIG. 2.

FIG. 3 shows one example of a portion of a circuit for generating the ramp pulse as shown in FIG. 2 and shows a portion of a driving circuit for generating the ramp down pulse B by using a capacitive load in order to operate a switch as constant current source.

Referring to FIG. 3, a resistor R1 is coupled between a control signal S1 input terminal and the gate of a transistor Q1, and a capacitor C1 is coupled between the gate and the drain of the transistor Q1. A capacitor Cgd represents parasitic capacitance between the gate and the drain of the transistor Q1, and a capacitor Cgs represents parasitic capacitance between the gate and the source of the transistor Q1.

As an example, when the voltage applied to the electrodes of the PDP is Vc, the voltage of the ramp pulse linearly increases with respect to a time axis so that the differential value of the voltage Vc is a constant value when the current is constant as shown in Equation 1.

$$Vc = \frac{1}{C}\int i\,dt \qquad \text{Equation 1}$$

$$\frac{dVc}{dt} = \frac{1}{C} \times i = \text{Constant}$$

In Equation 1, C is the capacitance of the display panel and has a constant value. Therefore, in order to generate the ramp pulse as shown in FIG. 2, the current flowed in the display panel must be constant.

Referring to FIGS. 2 and 3, in order for the transistor Q1 to be completely turned-on, the capacitor Cgs between the gate and the source of the transistor Q1 is first charged, and the capacitor Cgd between the gate and the drain is charged, using the control signal S1. Also, the capacitor Cgs is charged by the capacitor Cgd and the capacitor C1 so that the time for the voltage across the gate and the source of the transistor Q1 to exceed the threshold voltage of the transistor Q1 to completely turn on the transistor Q1 is extended by some extent. In other words, the capacitor Cgs is first charged through a path ① to slightly turn on the transistor Q1 so that a gate current can flow through a path ②. Then the capacitor Cgs starts to discharge through the formation of path ②, and the transistor Q1 is kept from being fully turned-on. As such, the transistor Q1 is operated as constant current source using a negative feedback effect through the paths ① and ② to generate the ramp down pulse B. The lowest voltage of the ramp down pulse B is higher than a scan voltage Vscn-l by a voltage ΔV that is the Zener voltage of a Zener diode D1

However, a conventional driving circuit for generating the ramp down pulse B as above has problems as follows.

The temperature of the PDP rises in accordance with the time during which the PDP has been in operation. When the temperature rises, the insulation characteristics of the dielectric or the protective film of the PDP deteriorate, and this can lead to leakage of the wall charges. As a result, the wall charges can move and recombine within a discharge space more easily, and this can lead to the loss of the wall charges. Accordingly, discharge condition is affected by temperature variation. Since the conventional driving circuit generates a constant ramp down pulse, it performs a normal discharge at a certain temperature, but it can perform mis-discharge at a lower temperature or a higher temperature. In other words, when the discharge starting voltage is lower at the lower temperature, over-discharge occurs, and when the discharge starting voltage is higher at the higher temperature, low-discharge occurs. If over-discharge occurs, the wall charges are excessively erased so that discharge can occur even in pixels not selected in the prior address period; and if low-discharge occurs, a significant amount of wall charges remain in pixels so that discharge error occurs when a subsequent address operation is made.

SUMMARY OF THE INVENTION

It is an aspect of the present invention to provide a driving device of a PDP capable of preventing or reducing discharge error due to temperature change.

It is another aspect of the present invention to provide a driving device of a PDP capable of maintaining optimal discharge condition when temperature of the PDP changes.

In one embodiment according to the present invention, there is provided a driving device of a plasma display panel having a plurality of pixels located at the crossings of a plurality of first and second electrodes, and a plurality of third electrodes. The driving device includes a sustain pulse supply for supplying a sustain voltage to the first electrodes; a ramp pulse supply for supplying a ramp up pulse having a voltage that increases from the sustain voltage at a constant slope, and a ramp down pulse having a voltage that decreases from the sustain voltage at a constant slope, to the first electrodes; and a scan voltage supply for supplying a first scan voltage and a second scan voltage to the first electrodes. The ramp pulse supply includes a first transistor coupled between a voltage source and a ramp up pulse outputting node and configured as constant current source; a second transistor configured as constant current source, a source of the second transistor coupled to a second scan voltage inputting terminal for inputting the second scan voltage; a resistive element coupled to a drain of the second transistor, the resistance value of the resistive element changing in response to temperature change; and a voltage dropping element coupled between the resistive element and a ramp down pulse outputting node.

In another embodiment according to the present invention, there is provided a method of driving a PDP during a reset period, the PDP having a plurality of pixels located at crossings of a plurality of first and second electrodes, and a plurality of third electrodes. The method includes applying a sustain voltage at a first voltage to the first electrodes; ramping up the sustain voltage from the first voltage at a constant slope to a second voltage; ramping down the sustain voltage from the second voltage to a third voltage at a constant slope; and adjusting the third voltage in response to temperature change.

BRIEF DESCRIPTION OF THE DRAWINGS

These and/or other embodiments and features of the invention will become apparent and more readily appreciated from the following description of certain exemplary embodiments, taken in conjunction with the accompanying drawings of which.

DETAILED DESCRIPTION OF EXEMPLARY EMBODIMENTS

Figure 1:
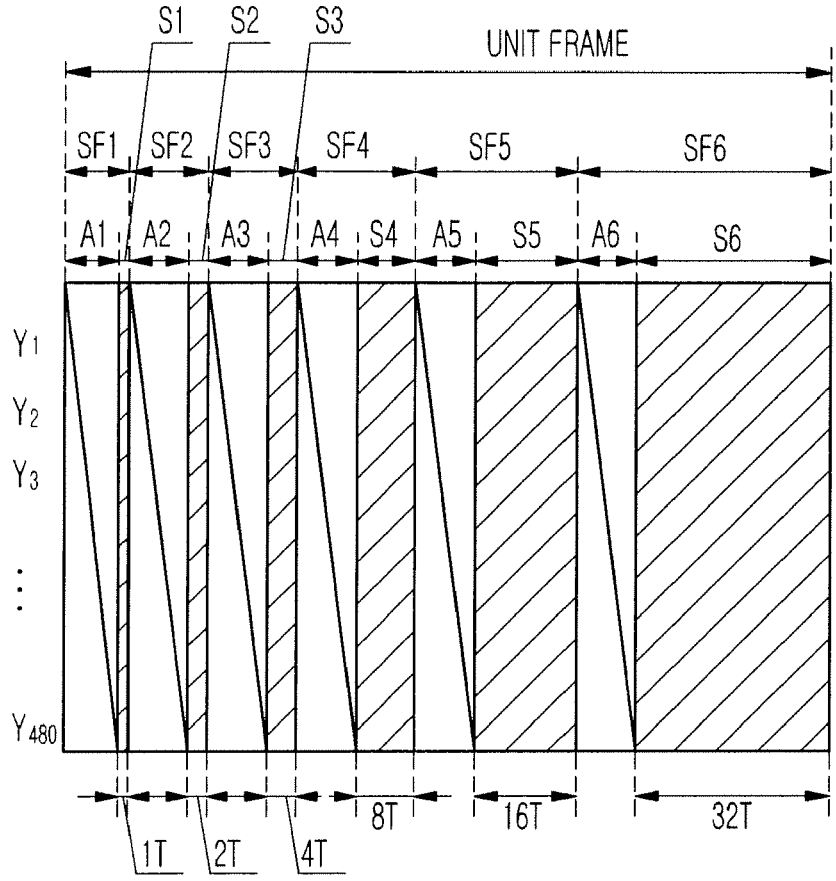
FIG. 1 (PRIOR ART)
FIG. 1 is a timing diagram showing a unit frame for displaying gray scale of an image on a PDP.
Figure 2:
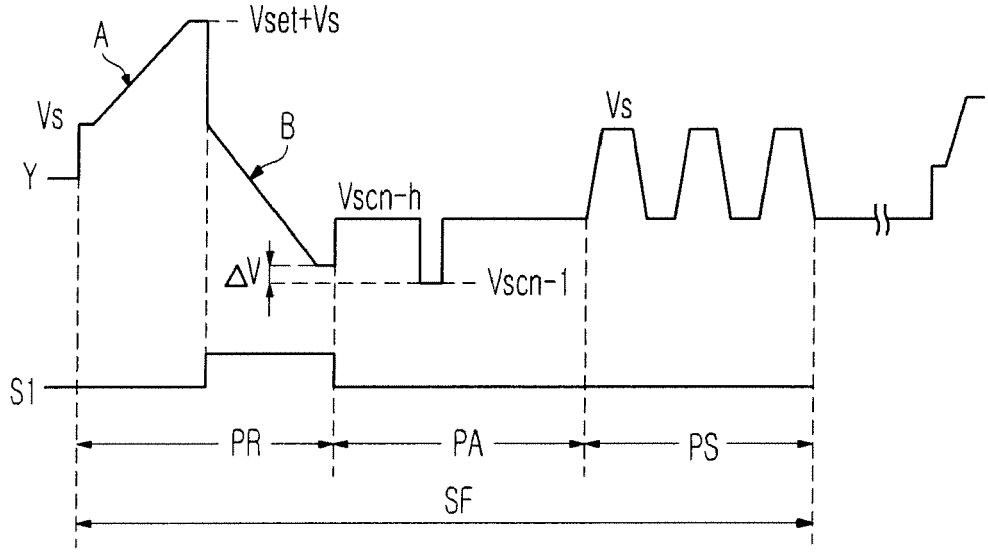
FIG. 2 (PRIOR ART)
FIG. 2 is a waveform diagram for explaining the operation of a PDP.
Figure 3:
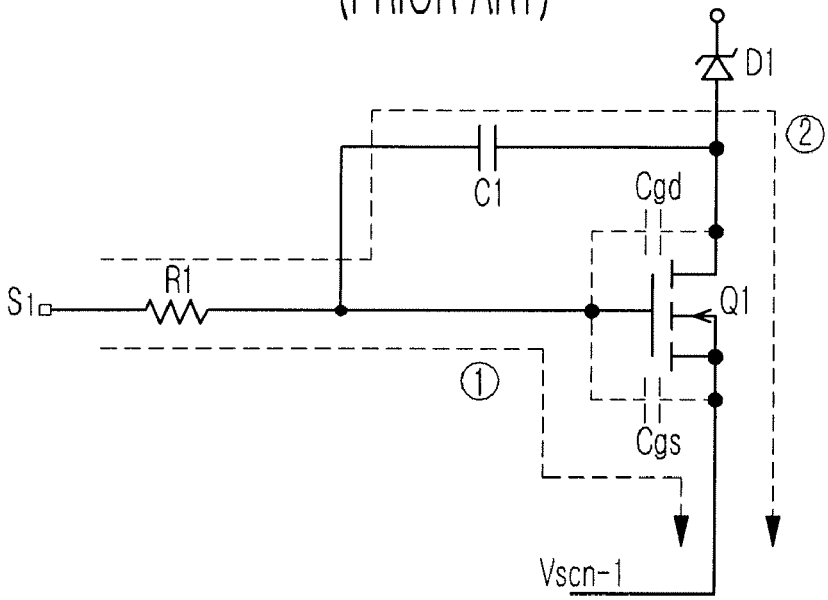
FIG. 3 (PRIOR ART)
FIG. 3 is a schematic circuit diagram of a driving device of a PDP.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. In addition, when an element is referred to as being "coupled to" another element, it can be directly connected to the another element or be indirectly connected to the another element with one or more intervening elements interposed therebetween. Hereinafter, like reference numerals refer to like elements.

Figure 4:
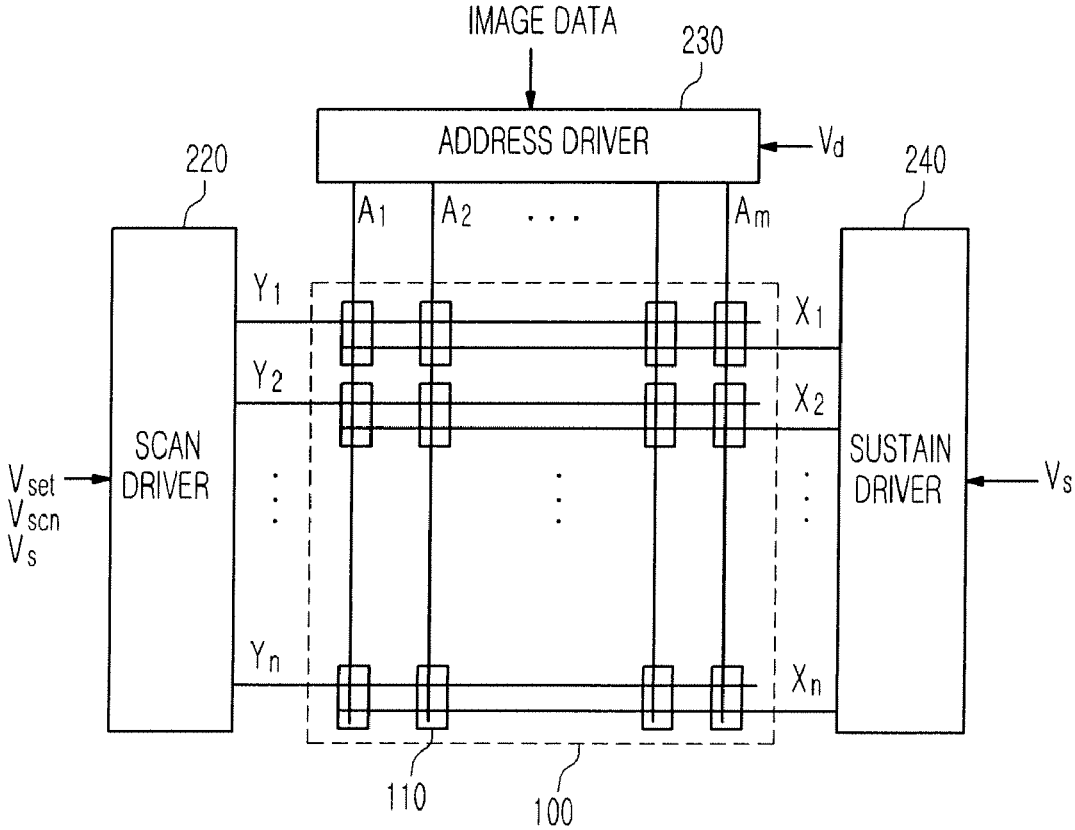
FIG. 4 is a block diagram of a driving device of a PDP according an embodiment of the present invention.

FIG. 4 is a block diagram of a driving device of a PDP according to an exemplary embodiment of the present invention.

Referring to FIG. 4, a PDP 100 includes a plurality of pixels 110 defined by a plurality of scan electrode lines $Y_1 \ldots Y_n$, a plurality of sustain electrode lines $X_1 \ldots X_n$ and a plurality of address electrode lines $A_1 \ldots A_m$ arranged to cross with the scan electrode lines $Y_1 \ldots Y_n$ and the sustain electrode lines $X_1 \ldots X_n$.

The scan electrode lines $Y_1 \ldots Y_n$ are coupled to a scan driver 220, the address electrode lines $A_1 \ldots A_m$ are coupled to an address driver 230, and the sustain electrode lines $X_1 \ldots X_n$ are coupled to a sustain driver 240.

Also, a plasma display device may further include an image processor for receiving analog image signals from an external source and generating digital image signals. In one embodiment according to the present invention, the image processor receives red (R), green (G) and blue (B) image data of 8 bits; a clock signal; and vertical and horizontal synchronizing signals. A logic controller is provided for generating control signals according to the internal image signals provided from the image processor; and a driving voltage generator is provided for generating a set up voltage Vset, scan voltages Vscn-l and Vscn-h, a sustain voltage Vs, and a data voltage Vd.

Figure 5:
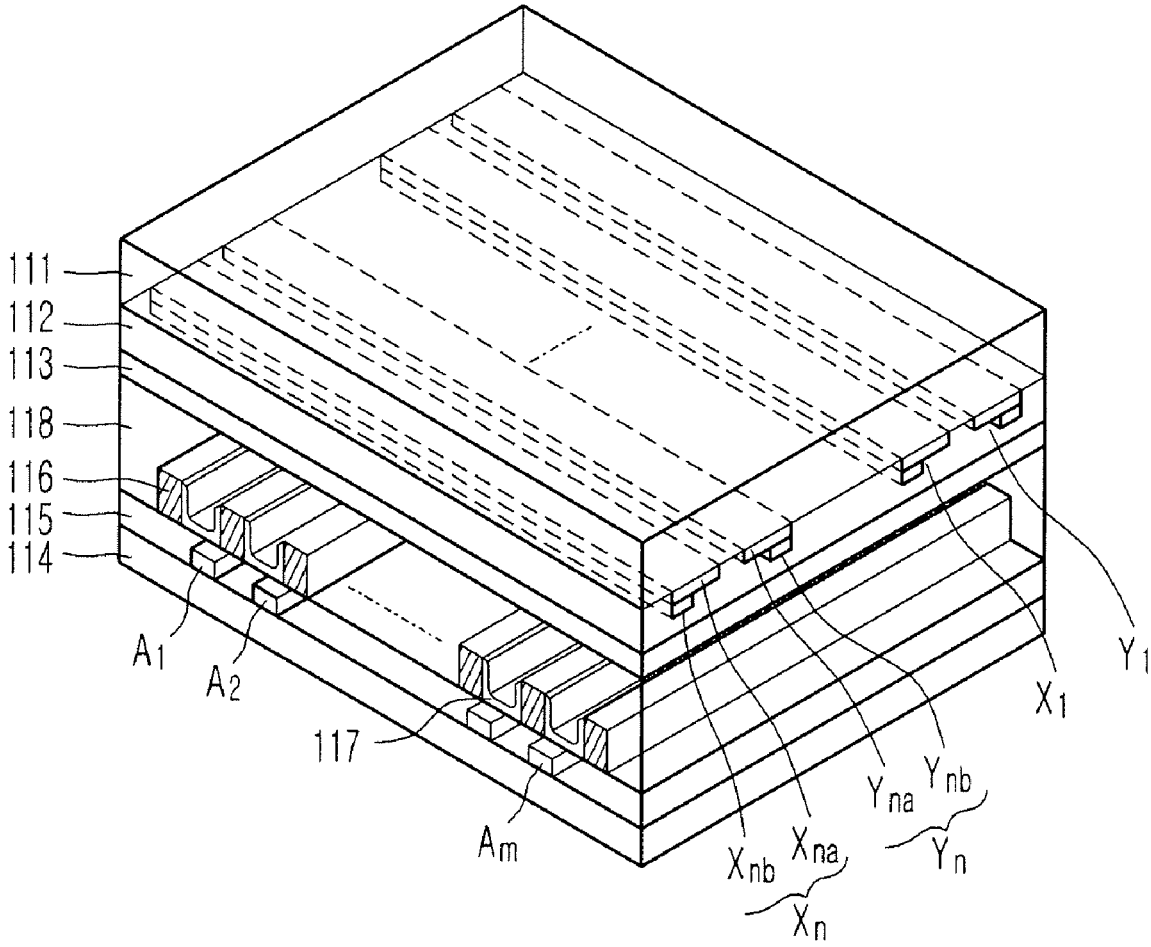
FIG. 5 is a perspective view of the PDP shown in FIG. 4.

FIG. 5 is a perspective view of the PDP 100 shown in FIG. 4, wherein the PDP 100 is shown as a three-electrode surface light emitting type.

On a first substrate 111, the plurality of sustain electrode lines $X_1 \ldots X_n$ and the plurality of scan electrode lines $Y_1 \ldots Y_n$ are covered with a dielectric 112 and a protective film 113. The sustain electrode lines $X_1 \ldots X_n$ and the scan electrode lines $Y_1 \ldots Y_n$ are formed to be parallel with each other. The protective film 113 is formed of MgO, or like material, which can prevent or reduce the damage of the dielectric 112 and increase the emission efficiency of secondary electrons The sustain electrode lines $X_1 \ldots X_n$ and the scan electrode lines $Y_1 \ldots Y_n$ include transparent electrodes $X_{na}$ and $Y_{na}$, formed of indium tin oxide (ITO), and electrodes $X_{nb}$ and $Y_{nb}$, formed of metal for improving conductivity.

The plurality of address electrode lines $A_1 \ldots A_m$ are formed on a second substrate 114 with spaces between adjacent address electrode lines. A dielectric 115 covers the address electrode lines $A_1 \ldots A_m$. On the dielectric 115, a plurality of barrier ribs 116 are formed and aligned with the corresponding spaces between the adjacent address electrode lines. The plurality of barrier ribs 116 extend in a direction parallel to the address electrode lines $A_1 \ldots A_m$. A plurality of phosphor layers 117 are formed on the sides of adjacent barrier ribs 116 and on the dielectric 115. The first substrate 111 and the second substrate 114 are arranged and bonded to make the scan electrode lines $Y_1 \ldots Y_n$ and the sustain electrode lines $X_1 \ldots X_n$ orthogonal to the address electrode lines $A_1 \ldots A_m$ so that a plurality of enclosed discharge spaces 118 are formed by the barrier ribs 116 and sealed with a gas for forming plasma, thereby forms the plurality of pixels 110 shown in FIG. 4. The gas for forming plasma is an inert mixing gas (e.g., He+Xe, Ne+Xe and He+Xe+Ne).

Figure 6:
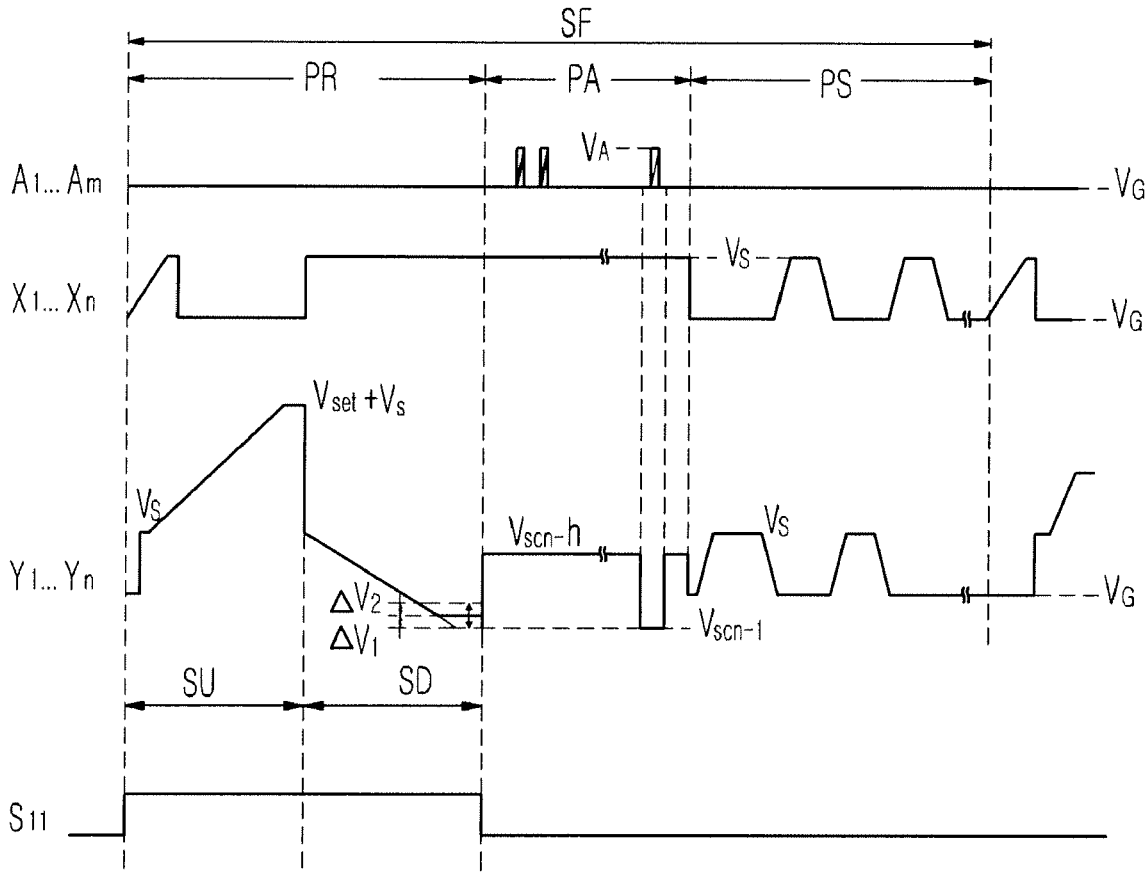
FIG. 6 is a waveform diagram for explaining the operation of a PDP according an embodiment of the present invention.

In the PDP as shown in FIG. 1, the unit frame is time-divided into a plurality of subfields SF1 to SF6; and in each subfield, a reset period PR, an address period PA and a sustain discharge period PS are sequentially performed using a voltage signal having a waveform as shown in FIG. 6 so that an image of desired gray scale is displayed.

Referring to FIG. 6, a reset period PR includes a set up period SU where a ramp up pulse is applied, and a set down period SD where a ramp down pulse is applied. The reset period PR is provided to completely erase the wall charges of pixels of which sustain discharges were performed in a previous subfield and to subsequently make the charge state of each of the pixels uniform so that the pixels may smoothly be selected again.

In the set up period SU, ramp up pulses are applied to the scan electrode lines $Y_1 \ldots Y_n$. The ramp up pulse increases from a sustain voltage Vs to a voltage equal to a set up voltage Vset plus the sustain voltage Vs (i.e., Vs+Vset) at a constant slope. The ramp up pulse generates a dark discharge which corresponds to little light being generated from the pixels. At the same time, positive (+) wall charges are accumulated on the address electrode lines $A_1 \ldots A_m$ and the sustain electrode lines $X_1 \ldots X_n$, and negative (−) wall charges are accumulated on the scan electrode lines $Y_1 \ldots Y_n$.

In the set down period SD, ramp down pulses are applied to the scan electrode lines $Y_1 \ldots Y_n$. The ramp down pulse starts to decrease from a positive (+) voltage, for example, that is lower than the voltage equal to the sum of the set up voltage Vset and the sustain voltage Vs, at a predetermined slop to a ground voltage $V_G$ or a negative (−) specific voltage, for example, a negative (−) scan voltage Vscn-l. Some of the wall charges excessively formed in the set up period SU are erased using the ramp down pulse so that the amount of the wall charges left in all the pixels are uniform, therefore, a correct address discharge can stably occur.

During the address period PA wall charges are accumulated on the pixels to be driven. During the address period PA, the scan voltage Vscn-l is sequentially applied to the scan electrode lines $Y_1 \ldots Y_n$, and at the same time, the data voltage Vd is applied to the address electrode lines $A_1 \ldots A_m$. As such, the potential of all the scan electrode lines $Y_1 \ldots Y_n$ may be sequentially changed from the positive (+) scan voltage Vscn-h to the negative (−) scan voltage Vscn-l.

The voltage difference between the scan voltage Vscn-l and the data voltage Vd is added to a wall voltage (e.g., a predetermined wall voltage) that is set up during the reset period PR, and concurrently, address discharges occur in selected pixels to which the data voltage Vd is applied to form sufficient wall charges for sustaining discharge in the selected pixels. At this time, the sustain voltage Vs is applied to the sustain electrode lines $X_1 \ldots X_n$ to decrease the voltage difference between the sustain electrode lines $X_1 \ldots X_n$ and the scan electrode lines $Y_1 \ldots Y_n$ to prevent or reduce misdischarge.

During the sustain discharge period PS, an image is displayed by discharging selected pixels when the sustain voltage Vs in a pulse form is alternately applied to the scan electrode lines $Y_1 \ldots Y_n$ and the sustain electrode lines $X_1 \ldots X_n$. In the selected pixels, the discharges are maintained between the scan electrode lines $Y_1 \ldots Y_n$ and the corresponding sustain electrode lines $X_1 \ldots X_n$ when every sustain pulse is applied, while adding the voltage of the sustain voltage Vs to the wall voltage of the selected pixels, thereby displaying an image.

When the sustain discharge period PS is completed, a voltage signal having low width and level is applied to all the sustain electrode lines $X_1 \ldots X_n$ so that the wall charges remained in all the pixels are erased.

Figure 7:
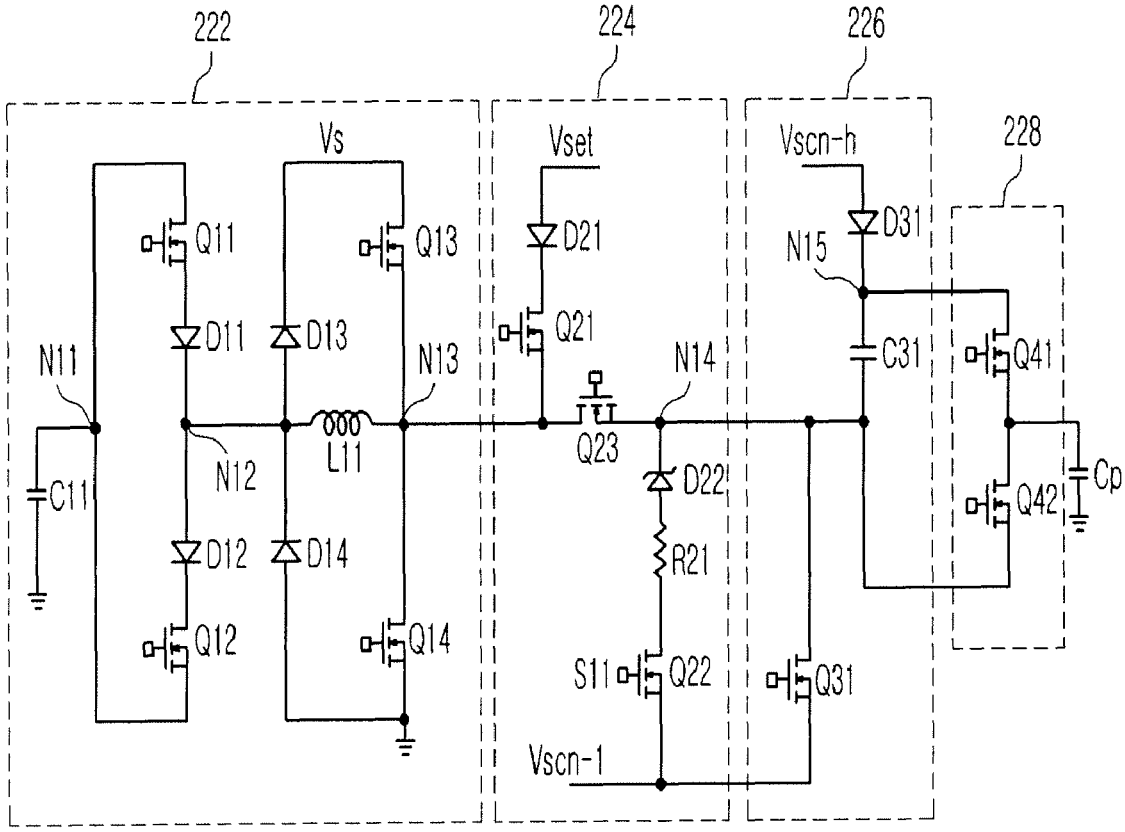
FIG. 7 is a detailed circuit diagram of the scan driver shown in FIG. 4.

FIG. 7 is a detailed circuit diagram of the scan driver 220 shown in FIG. 4 according to an embodiment of the present invention. The scan driver 220 is configured to generate a ramp down pulse whose lowest potential is changed in response to temperature change.

The scan driver 220 includes a sustain pulse supply 222 for supplying the sustain voltage Vs to the scan electrode lines $Y_1 \ldots Y_n$; a ramp pulse supply 224 for supplying the ramp up pulse increasing at a constant slope from the sustain voltage Vs and the ramp down pulse decreasing at a constant slope from the sustain voltage Vs to the scan electrode lines $Y_1 \ldots Y_n$; a scan voltage supply 226 for supplying the first and second scan voltages Vscn-h and Vscn-l to the scan electrode lines $Y_1 \ldots Y_n$; and an output unit 228 for transferring the sustain voltage Vs, the ramp up pulse, the ramp down pulse, and the first scan voltage Vscn-h and the second scan voltage Vscn-l to the scan electrode lines $Y_1 \ldots Y_n$. A panel capacitor Cp represents capacitance between the scan electrode lines $Y_1 \ldots Y_n$ and the corresponding sustain electrode lines $X_1 \ldots X_n$ and address electrode lines $A_1 \ldots A_m$, and indicates capacitance inside the display panel.

The sustain pulse supply 222 includes a capacitor C11 coupled between a node N11 and ground; a transistor Q11 and a diode D11 serially coupled between the node N11 and a node N12; a transistor Q12 and a diode D12 serially coupled between the node N11 and the node N12; an inductor L11 coupled between the node N12 and a ramp up pulse outputting node N13; a transistor Q13 coupled between a sustain voltage Vs inputting terminal and the ramp up pulse outputting node N13; a transistor Q14 coupled between the ramp up pulse outputting node N13 and ground; a diode D13 coupled between the node N12 and the sustain voltage Vs inputting terminal; and a diode D14 coupled between ground and the node N12. The transistors Q11 to Q14 are operated by respective control signals.

If the sustain discharge period PS is performed in a state that the capacitor C11 is charged at a voltage of Vs/2, the transistor Q11 is turned-on so that the potential of the ramp up pulse outputting node N13 rises up to the scan voltage Vs due to the resonance of the inductor L11 and the capacitor C11 at the voltage Vs/2. When the potential of the ramp up pulse outputting node N13 reaches the scan voltage Vs, the transistor Q13 is turned-on so that the potential of the ramp up pulse outputting node N13 is maintained at the scan voltage Vs supplied by a scan voltage source, and the transistor Q23 is turned-on so that the panel capacitor Cp is charged. After this, when the transistor Q12 is turned-on, the voltage charged in the panel capacitor Cp is recovered to the capacitor C11 by the resonance so that the capacitor is charged with the voltage of Vs/2, and when the transistor Q14 is turned-on, the potential of the ramp up pulse outputting node N13 is maintained at ground potential. Sustain pulses of the sustain voltage are applied to the scan electrode lines $Y_1 \ldots Y_n$ of the pixels selected by the operation described above.

The ramp pulse supply 224 includes a transistor Q21 configured as a constant current source, wherein the drain of the transistor Q21 is coupled to a voltage source Vset through a diode D21, and its source is coupled to the ramp up pulse outputting node N13; a transistor Q22 configured as constant current source, wherein its source is coupled to a second scan voltage Vscn-l inputting terminal; a resistor element R21 coupled to the drain of the transistor Q22, the resistor element R21 changing its resistance value in response to temperature change; a voltage dropping element D22 coupled between the resistor element R21 and a ramp down pulse outputting node N14; and a transistor Q23 coupled between the ramp up pulse outputting node N13 and the ramp down pulse outputting node N14. The transistors Q21 to Q23 are operated by corresponding control signals. The resistor element R21 may be positive temperature coefficient (PTC) thermistor that experiences resistance value increase in response to temperature increase, or a negative temperature coefficient (NTC) thermistor that experiences resistance value decrease in response to temperature increase. The voltage dropping element D22 may be a Zener diode.

Figure 8A:
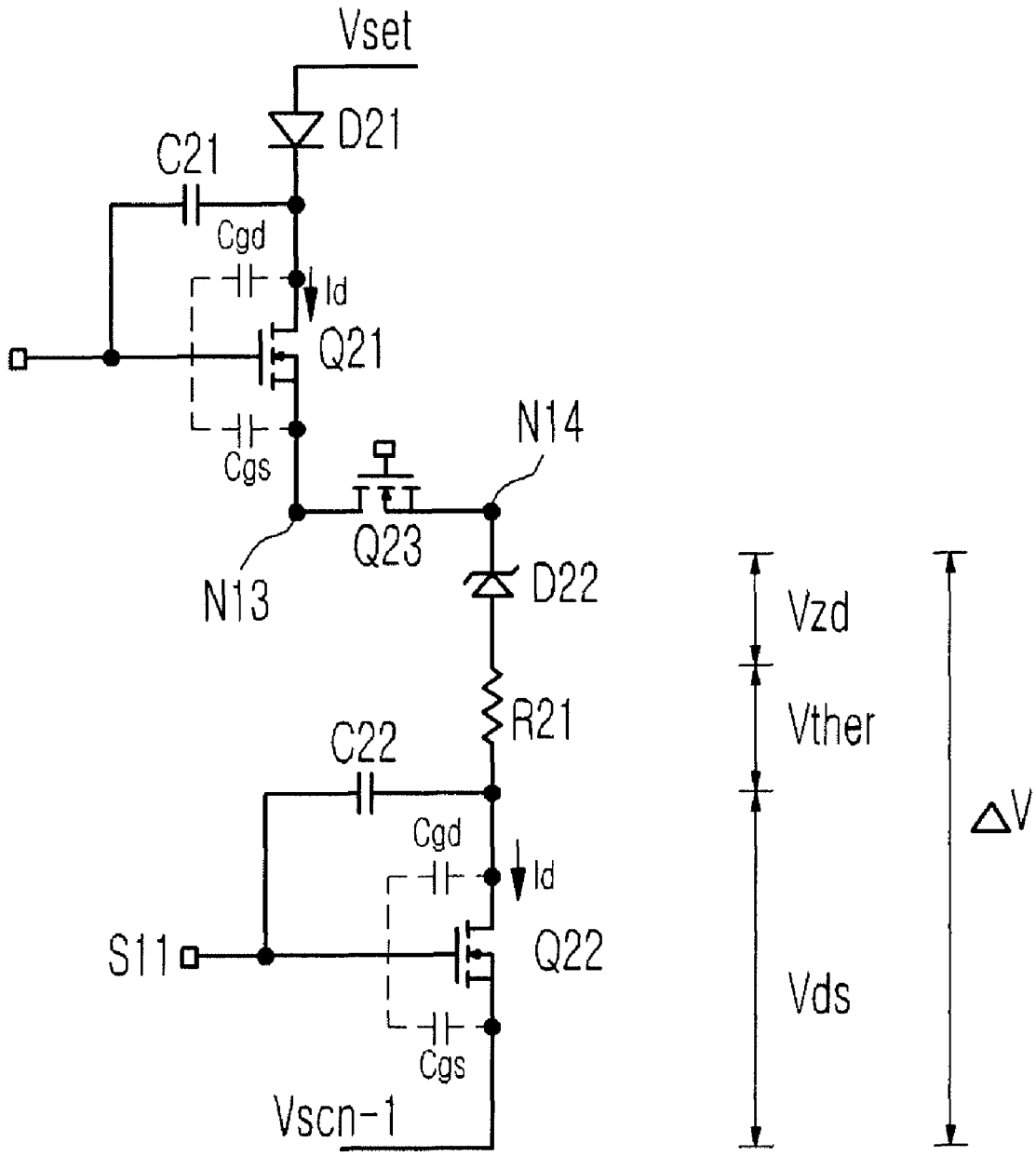
FIGS. 8A and 8B are schematic circuit diagrams of exemplary embodiments of the ramp pulse generator shown in FIG. 7.
Figure 8B:
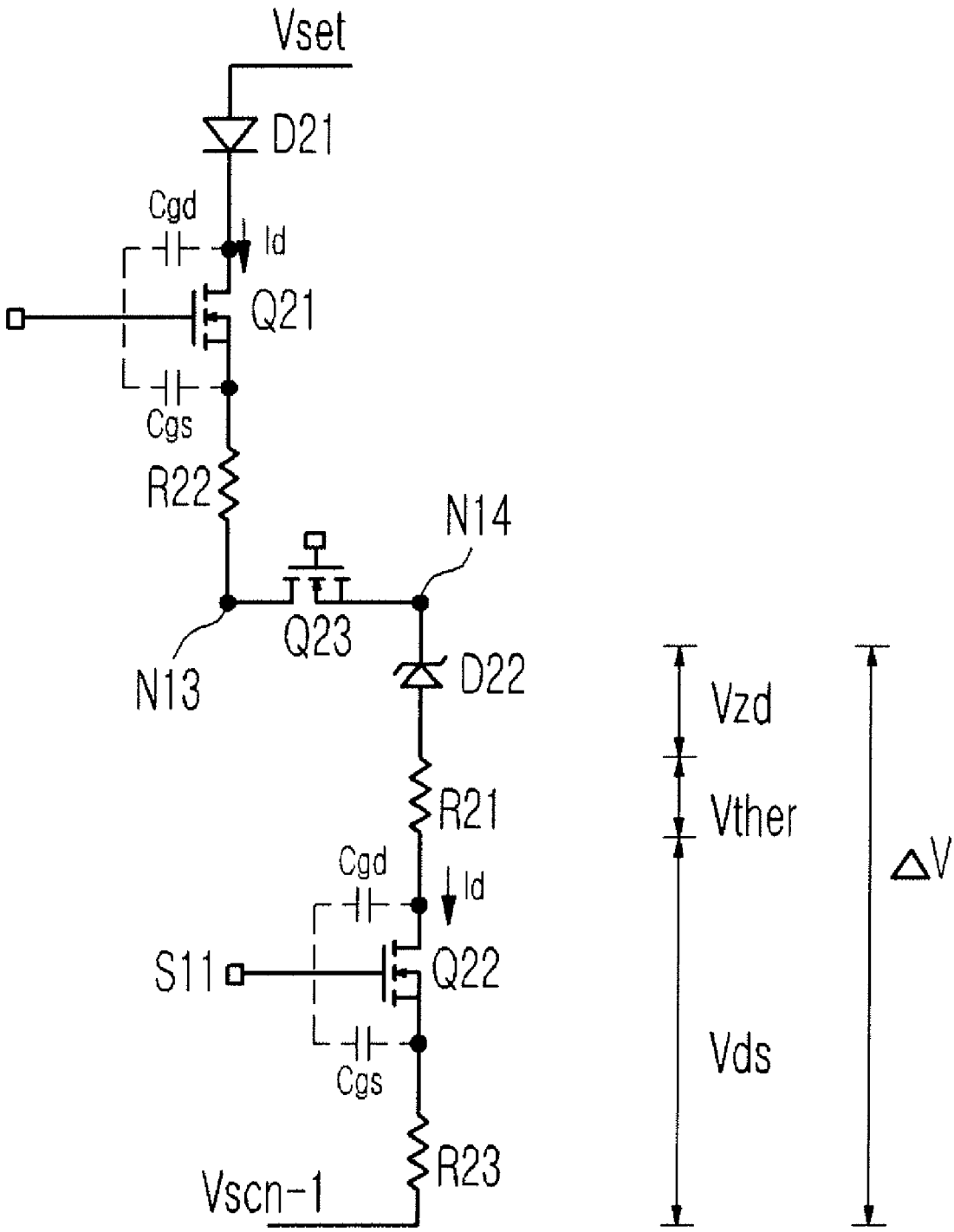

Referring to FIG. 8A, in one exemplary embodiment, in order for the transistors Q21 and Q22 to be operated as constant current sources, capacitors C21 and C22 may be coupled between the gates and the drains of transistors Q21 and Q22, respectively. Referring to FIG. 8B, in another exemplary embodiment, a resistor R22 is coupled between the source of the transistor Q21 and the ramp up pulse outputting node N13, and a resistor R23 is coupled between the source of the transistor Q22 and the second scan voltage Vscn-l inputting terminal. In FIGS. 8A and 8B, capacitors Cgd are respective parasitic capacitance between the respective gates and the respective drains of the transistors Q21 and Q22, and capacitors Cgs are respective parasitic capacitance between the respective gates and sources thereof.

Referring back to FIG. 6, in the set up period SU of the reset period PR, the ramp up pulse is applied to all the scan electrode lines $Y_1 \ldots Y_n$; and in the set down period SD, the ramp down pulse is applied to all the scan electrode lines $Y_1 \ldots Y_n$.

Referring to FIG. 8A, in order for the transistor Q22 to be completely turned-on, the capacitor Cgs between the gate and the source of the transistor Q22 should first be charged by a control signal S11, and the capacitor Cgd between the gate and the drain of transistor Q22 should be charged. At this time, the capacitor Cgs is charged by the capacitor Cgd and the capacitor C22 so that the time for the voltage across the capacitor Cgs to exceed the threshold voltage of the transistor Q22 to completely turn on the transistor Q22 extends to some extent using the capacitor C22. In other words, the capacitor Cgs is charged to a voltage that can slightly turn on the transistor Q22 so that the gate current flows in the display panel. Then, the capacitor Cgs begins to discharge to prevent the transistor Q22 from being completely turned-on. Thus, the transistor Q22 is operated as constant current source using a negative feedback effect described above to generate the ramp down pulse.

The voltage of the ramp down pulse decreases at a constant slope from the sustain voltage Vs toward the second scan voltage Vscn-l. The lowest voltage of the ramp down pulse is different from the second scan voltage Vscn-l by a voltage ΔV that is the sum of a voltage Vzd of the voltage dropping element D22, a voltage Vther across the resistor R21 whose resistance value changes in response to temperature change and a voltage Vds across the drain and source of the transistor Q22.

Referring to FIG. 8B, when the control signal S11 is input to the gate of the transistor Q22, the capacitor Cgs of the transistor Q22 is charged, and the transistor Q22 is turned-on so that a current Id begins to flow to the drain. As the current Id starts to flow, the amount of current of the current Id increases rapidly. Since the potential of the control signal S11 is held constant, the voltage across the capacitor Cgs of the transistor Q22 decreases as the voltage across the resistor R23 increases in response to the increasing current Id. Therefore, the voltage of the capacitor Cgs is lower, and the transistor Q22 is turned-off. At the same time, the magnitude of the current Id flowing from the drain to the source of transistor Q22 decreases so that the voltage drop across the resistor R23 also decreases. Accordingly, the voltage across the capacitor Cgs of the transistor Q22 increases again, and the transistor Q22 is again turned-on. As such, the transistor Q22 is operated as constant current source by the negative feedback effect described above to generate the ramp down pulse with a constant slop.

The ramp down pulse decreases at a constant slope from the sustain voltage Vs toward the second scan voltage Vscn-l. The lowest potential of the ramp down pulse is different from the second scan voltage Vscn-l by a voltage ΔV shown in FIG. 8B. The voltage ΔV is the sum of a voltage Vzd across the voltage dropping element D22, a voltage Vther across the resistor R21 whose resistance value changes in response to temperature change, and a voltage Vds across the drain and source of the transistor Q22.

The following table 1 illustrates how the voltage ΔV changes in response to temperature change, when a current of 200 mA flows from the voltage dropping element D22 through the transistor Q22 assuming the conduction loss of the transistor Q22 does not exist.

TABLE 1

| Temperature(° C.) | Resistance Value(Ω) | Vther(V) | ΔV(V) |
|---|---|---|---|
| −10 | 1 | 0.2 | 20.2 |
| 0 | 5 | 0.5 | 20.5 |
| 10 | 10 | 2 | 22 |
| 20 | 15 | 3 | 23 |
| 30 | 20 | 4 | 24 |
| 40 | 25 | 5 | 25 |
| 50 | 30 | 6 | 26 |

In one exemplary embodiment, the PDP 100 shown in FIG. 4 has a low discharge starting voltage at low temperature and high discharge starting voltage at high temperature. If a constant drain current as described in Equation 1 flows through the sustain circuit 240, as ambient temperature rises, the discharge starting voltage increases, as a result, low discharge of the pixels can occur. However, the lowest potential of the ramp down pulse is increased by a voltage ΔV2 by increasing the resistance of the resistor R21 as temperature rises. On the contrary, when ambient temperature is low, the discharge starting voltage decreases, as a result, an over-discharge can occur. However, the lowest potential of the ramp down pulse is decreased by a voltage ΔV1 by decreasing the resistance of the resistor R21.

Accordingly, the amount of the wall charges erased over a temperature range from high to low is substantially constant so that the amount of the wall charges in all the pixels are constantly maintained through the temperature range, making it possible to prevent or reduce discharge error and perform the low voltage address operation, in the address period.

The process for generating the ramp down pulse by operating the transistor Q22 as constant current source has been described in the foregoing embodiments; however, since the process for generating the ramp up pulse by the transistor Q21 operated as constant current source follows the same principle described above, those skilled in the art will be able to understand and the description thereof will be omitted.

In the above exemplary embodiments, the resistor R21 is illustrated as a positive temperature coefficient (PTC) thermistor; however, in other embodiments, if the discharge starting voltage decreases at a higher temperature and increases at a lower temperature according to the temperature dependency of the discharge characteristic of the PDP 100, negative temperature coefficient (NTC) thermistor that experiences resistance value decrease in response to temperature increase may be used for the resistor R21.

Referring to FIG. 7, the scan voltage supply 226 includes a diode D31 coupled between the first scan voltage Vscn-h inputting terminal and the output node N15; a capacitor C31 coupled between the output node N15 and the ramp down pulse outputting node N14; and a transistor Q31 coupled between the ramp down pulse outputting node N14 and the second voltage Vscn-l inputting terminal. The transistor Q31 is operated by a corresponding control signal.

Referring back to FIG. 6, during the address period PA, the first scan voltage Vscn-h is applied to the scan electrode lines $Y_1 \ldots Y_n$ through the diode D31, and the transistor Q31 is turned-on according to the control signal to apply the second scan voltage Vscn-l to the scan electrode lines $Y_1 \ldots Y_n$.

The output unit 228 includes a transistor Q41 coupled between the output node N15 of the scan voltage supply 226 and the scan electrode lines $Y_1 \ldots Y_n$, a transistor Q42 coupled between the ramp down pulse outputting node N14 and the scan electrode lines $Y_1 \ldots Y_n$. The transistors Q41 and Q42 are operated by corresponding control signals.

The transistors Q41 and Q42 are turned-on according to the corresponding control signals to transfer the sustain voltage Vs, the ramp up pulse, the ramp down pulse, the first scan voltage Vscn-h, and the second scan voltage Vscn-l to the scan electrode lines $Y_1 \ldots Y_n$.

As described above, exemplary embodiments of the present invention changes the lowest potential of the ramp down pulse in response to temperature change in order to prevent low discharge or over-discharge due to temperature change. Accordingly, the amount of wall charges in the pixels are maintained substantially constant over a temperature range from high to low to maintain an optimal discharge condition. Thus, it is possible to prevent discharge error and perform the low voltage address operation, in the address period. Accordingly, the reliability of a plasma display panel can be improved.

Exemplary embodiments of the present invention have been described with respect to the detailed description and the drawings. The terms and embodiments are used not for limiting the scope of the invention described in the claims, but only for explaining the embodiments of the present invention. Therefore, it would be appreciated by those skilled in the art that changes might be made to the embodiments without departing from the principles and spirit of the present invention, the scope of which is defined in the claims and their equivalents.

What is claimed is:

1. A driving device of a plasma display panel (PDP) having a plurality of pixels located at crossing of a plurality of first and second electrodes and a plurality of third electrodes, the driving device comprising:

a sustain pulse supply for supplying a sustain voltage to the first electrodes;

a ramp pulse supply for supplying a ramp up pulse having a voltage that increases from the sustain voltage at a constant slope, and a ramp down pulse having a voltage that decreases from the sustain voltage at a constant slope, to the first electrodes; and a scan voltage supply for supplying a first scan voltage and a second scan voltage to the first electrodes, wherein the ramp pulse supply comprises a first transistor coupled between a voltage source and a ramp up pulse outputting node and configured as constant current source; a second transistor configured as constant current source, a source of the second transistor coupled to a second scan voltage inputting terminal for inputting the second scan voltage; a resistive element coupled to a drain of the second transistor, the resistance value of the resistive element changing in response to temperature change; and a voltage dropping element coupled between the resistive element and a ramp down pulse outputting node.

2. The driving device of the PDP as claimed in claim 1, wherein the sustain pulse supply comprises:

a capacitor coupled between a first node and a ground;

a third transistor and a first diode serially coupled between the first node and a second node;

a fourth transistor and a second diode serially coupled between the first and second nodes;

an inductor coupled between the second node and the ramp up pulse outputting node;

a fifth transistor coupled between a sustain voltage inputting terminal and the ramp up pulse outputting node; and a sixth transistor coupled between the ramp up pulse outputting node and the ground.

3. The driving device of the PDP as claimed in claim 1, further comprising a third transistor coupled between the ramp down pulse outputting node and the ramp up pulse outputting node.

4. The driving device of the PDP as claimed in claim 1, further comprising a first capacitor coupled between a gate and a drain of the first transistor and a second capacitor coupled between a gate and the drain of the second transistor.

5. The driving device of the PDP as claimed in claim 1, further comprising:

a first resistor coupled between the source of the first transistor and the ramp up pulse outputting node; and a second resistor coupled between the source of the second transistor and the second scan voltage inputting terminal.

6. The driving device of the PDP as claimed in claim 1, wherein the resistive element comprises a thermistor having a resistance value that increases in response to temperature increase.

7. The driving device of the PDP as claimed in claim 1, wherein the resistive element comprises a thermistor having a resistance value that increases in response to temperature decrease.

8. The driving device of the PDP as claimed in claim 1, wherein the lowest potential of the ramp down pulse is determined according to the resistance value of the resistive element.

9. The driving device of the PDP as claimed in claim 8, wherein the lowest potential of the ramp down pulse increases when the resistance value of the resistive element increases.

10. The driving device of the PDP as claimed in claim 8, wherein the lowest potential of the ramp down pulse decreases when the resistance value of the resistive element decreases.

11. The driving device of the PDP as claimed in claim 1, wherein the voltage dropping element is a Zener diode.

12. The driving device of the PDP as claimed in claim 1, wherein the scan voltage supply comprises:

a diode coupled between a first scan voltage inputting terminal for inputting the first scan voltage and an output node;

a capacitor coupled between the output node and the ramp down pulse outputting node; and a third transistor coupled between the ramp down pulse outputting node and the second scan voltage inputting terminal.

13. The driving device of the PDP as claimed in claim 1, further comprising an output unit for transferring the sustain voltage, the ramp up pulse, the ramp down pulse, and the first scan voltage and the second scan voltage to the first electrodes.

14. The driving device of the PDP as claimed in claim 13, wherein the output unit comprises:

a third transistor coupled between the first electrodes and the output node of the scan voltage supply; and a fourth transistor coupled between the first electrodes and the ramp down pulse outputting node.

* * * * *